US012529292B2

(12) United States Patent
Fripp et al.

(10) Patent No.: US 12,529,292 B2
(45) Date of Patent: Jan. 20, 2026

(54) SEAL AND ANCHOR FOR EXPANDABLE LINER HANGERS

(71) Applicant: Halliburton Energy Services, Inc., Houston, TX (US)

(72) Inventors: Michael Linley Fripp, Singapore (SG); Mark S. Holly, Singapore (SG); Daniel Craig Newton, Singapore (SG); Chee Sing Kelvin Loh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/803,123

(22) Filed: Aug. 13, 2024

(65) Prior Publication Data

US 2025/0059857 A1 Feb. 20, 2025

Related U.S. Application Data

(60) Provisional application No. 63/532,849, filed on Aug. 15, 2023.

(51) Int. Cl.
*E21B 43/10* (2006.01)
*E21B 33/129* (2006.01)

(52) U.S. Cl.
CPC ..... *E21B 43/103* (2013.01); *E21B 33/129* (2013.01); *E21B 43/105* (2013.01)

(58) Field of Classification Search
CPC .. E21B 43/103; E21B 43/105; E21B 33/1212; E21B 33/122; E21B 33/29; E21B 33/1208; E21B 33/129; E21B 23/01; E21B 23/06; E21B 43/108
See application file for complete search history.

(56) References Cited

U.S. PATENT DOCUMENTS

| | | | | |
|---|---|---|---|---|
| 8,607,861 | B2 | 12/2013 | Saylor, III et al. | |
| 8,939,220 | B2 | 1/2015 | Harris | |
| 9,518,453 | B2 | 12/2016 | Dilber et al. | |
| 9,752,400 | B2 | 9/2017 | Hazelip et al. | |
| 10,415,336 | B2 * | 9/2019 | Benzie | E21B 43/26 |
| 2002/0166668 | A1 | 11/2002 | Metcalfe et al. | |
| 2014/0174763 | A1 | 6/2014 | Zhong et al. | |
| 2021/0115764 | A1 | 4/2021 | Zhong et al. | |
| 2022/0145712 | A1 | 5/2022 | Bermudez et al. | |
| 2023/0374890 | A1 * | 11/2023 | Zhong | E21B 43/103 |

FOREIGN PATENT DOCUMENTS

CN 112065321 A 12/2020

OTHER PUBLICATIONS

International Search Report and Written Opinion for International Patent Application No. PCT/US2024/042340 dated Nov. 26, 2024. PDF file. 17 pages.

* cited by examiner

*Primary Examiner* — Yong-Suk (Philip) Ro
(74) *Attorney, Agent, or Firm* — Scott Richardson; C. Tumey Law Group PLLC

(57) ABSTRACT

Disclosed is a variety of methods and apparatus for an expandable liner hanger including a first raised portion as a sealing element of a first material. The first raised portion may be configured to engage a casing in a wellbore to form a seal between the expandable liner hanger and the casing. The expandable liner hanger may also include a second raised portion as an anchor that is a second material, wherein the first material is softer than the second material. The second raised portion may be configured to engage the casing to anchor the expandable liner hanger with the casing.

20 Claims, 7 Drawing Sheets

1000

1100

SEAL AND ANCHOR FOR EXPANDABLE LINER HANGERS

BACKGROUND

Boreholes (wellbores) may be drilled into subterranean formations to recover valuable hydrocarbons, among other functions. Operations may be performed before, during, and after the wellbore has been drilled to produce and continue the flow of the hydrocarbon fluids to the surface.

When performing subterranean operations, the wellbore is typically drilled and completed to facilitate removal of the desired materials (e.g., hydrocarbons) from the subterranean formation. Often, once a wellbore is drilled, a casing may be inserted into the wellbore. Cement may then be used to install the casing in the wellbore and prevent migration of fluids in the annulus between the casing and the wellbore wall. In certain implementations, the casing may be made of heavy steel.

Once an upper portion of the wellbore has been drilled and cased, it may be desirable to continue drilling and to line a lower portion of the wellbore with a liner lowered through the upper cased portion thereof. Liner hangers are typically used to mechanically support an upper end of the liner from the lower end of a previously installed casing. Additionally, liner hangers may be used to seal the liner to the casing.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
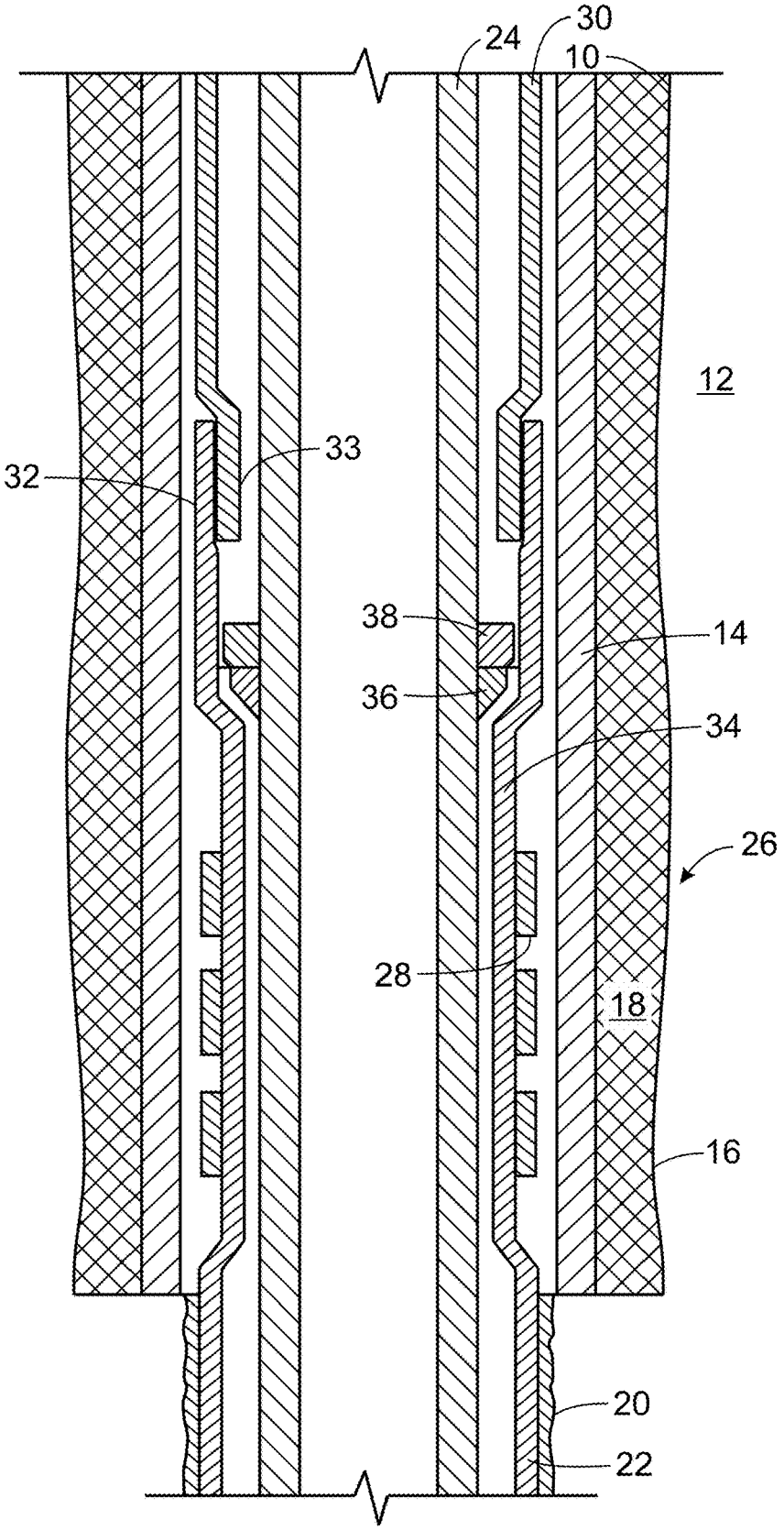
FIG. 1 is a diagram of an expandable liner hanger (ELH).

Some aspects of the present disclosure include expandable liner hangers having a seal (e.g., a soft metal) and an anchor (e.g., a hard metal that may include ceramic). The seal and the anchor can each be a raised portion, such as a spike form, a ring, ridges, ribs, and/or a band, etc. The raised portion can be characterized as a protruding portion, protrusion(s), raised part, elevated portion, extended portion, and the like. The seal and the anchor may be utilized in conjunction (together) on the same expandable liner hanger or separately on different respective liner hangers. The seal and anchor may be fabricated (manufactured) by additive manufacturing, such as three-dimensional (3D) printing or other forms of additive manufacturing. If 3D printing is employed, the 3D printing may broadly include implementation options on types of 3D printing. The seal and/or anchor may be fabricated by subtractive manufacturing.

Liner hangers are typically used to mechanically support an upper end of the liner from the lower end of a previously installed casing. Additionally, liner hangers may be employed to seal the liner to the casing. Embodiments of the present techniques include an expandable liner hanger having the seal (e.g., 3D printed seal) or the anchor (e.g., 3D printed anchor), or both. Again, the seal and the anchor may each be a raised portion as respectively a 3D printed seal and a 3D printed anchor for expandable liner hangers. The 3D printed seal and the 3D printed anchor may be utilized in conjunction or separately.

The softness or hardness of the metals (e.g., printed metals) of the raised portions as the seal and anchor may be characterized relative to the wellbore casing and hanger material properties. The soft metal (e.g., as a seal raised portion) would generally have a lower yield strength than either the wellbore casing or hanger (e.g., whichever is less in yield strength) and would typically be ductile. Conversely, the hard metal (e.g., as an anchor raised portion) would generally have a higher yield strength than the casing. This may facilitate the hard metal to bite into the casing.

The soft material raised portion may be, for example, at least 20% (e.g., in the range of 20% to 50%) softer than the casing or liner. The hard material raised portion may be, for example, at least 20% (e.g., in the range of 20% to 50%) harder than the casing or liner.

Hardness can be proportional to yield strength. This can be utilized for the definition of what is soft and hard in defining relative to the casing or liner. For instance, the soft material may have at least 20% lower yield strength than the casing or liner and the hard material may have at least 20% higher yield strength than the casing or liner. The casing (and liner) material properties can vary.

The hardness of the present raised portion can range, for example, from 207 HBW to 311 HBW, taking into account material having ultimate tensile strength (as stress) of 80 kilopounds per square inch (ksi) to 125 ksi material. Numerical values outside these numerical ranges are applicable. For instance, the softer raised portion utilized as a seal may have a hardness less than 207 HBW. The harder raised portion, that is an anchor may have a hardness greater than 311 HBW. The designation "HBW" specifies the use of a tungsten carbide ball indenter in determining the hardness. The Brinell hardness number (BHN) is designated by common test standards as HBW (H from hardness, B from Brinell, and W from the material of the indenter [tungsten (wolfram) carbide]). Such common standards include, for example, American Society for Testing and Materials (ASTM) standard E10-14 "Standard Test Method for Brinell Hardness of Metallic Materials" (last updated Aug. 3, 2023) of ASTM international; and International Organization for Standardization (ISO) 6506-1:2014 "Metallic materials—Brinell hardness test" (last reviewed and confirmed in 2019).

The 3D printed anchor raised portion is generally a harder material than the 3D printed seal raised portion and harder than the base metal (base pipe). The 3D printed seal raised portion (sealing element) is generally a softer material than the 3D printed anchor raised portion and softer than the base metal (base pipe). Applicable 3D printing for manufacturing the raised portions may include, for example, selective laser sintering (SLS), selective laser melting (SLM), directed energy deposition (DED) such as powder DED and wire DED, and bound powder printing, and so on. In lieu of (or in addition to 3D printing), additional additive manufacturing techniques are applicable, such as welding, brazing, etc. Additive manufacturing is different than subtractive manufacturing (e.g., milling, grinding, machining, etc.). The raised parts (portions) that are constructed through additive manufacturing may further have a subtractive manufacturing to achieve the desired final profile of the raised part.

As mentioned, the two raised portions (an anchor raised portion and a seal raised portion, respectively) can be run together on an expandable liner hanger, or on the other hand, the two raised portions can be run independent (separately) as not on the same expandable liner hanger.

The expandable liner hanger in accordance with embodiments herein provides a technique (e.g., via an anchor raised portion such as a 3D printed anchor raised portion) of securing the hanger to the casing in a wellbore, and a technique (e.g., via a sealing element raised portion such as a 3D printed seal raised portion) of creating (providing) a hydraulic seal (fluid seal) between the expandable liner hanger and the wellbore casing. For the annulus between the expandable liner hanger and the wellbore casing, the fluid seal may provide that in the annulus, uphole of the expandable liner hanger is fluidically sealed from downhole of the expandable liner hanger. In implementations, the anchor raised portion and the seal raised portion are fixed with respect to the base pipe (e.g., tool mandrel and/or liner). In embodiments, the anchor raised portion and the seal raised portion do not move axially with respect to the base pipe during the setting process. In implementations, the anchor raised portion and the seal raised portion are permanently affixed to the base pipe. There is generally no movement of the anchor raised portion or the seal raised portion with respect to the base pipe. The anchor raised portion and the seal raised portion may be proximate to each other. They may touch each other. The anchor raised portion and the seal raised portion being proximate to each other may mean that the space between the anchor raised portion and seal raised portion is in the range of less than ten times (10×) [or less than three times (3×)] the width of the base of either raised portion.

As indicated, disclosed herein are expandable liner hangers, such as for utilization with a wellbore in subterranean formation. An expandable liner hanger may be an apparatus for extending the length of an existing tubular such as a casing or liner string of the wellbore. In implementations, expandable liner hangers may be hung by external expansion of the hanger against the inner wall of the previously set casing string in. In implementations, expandable liner hanger can be an integrated hanger packer system. Expandable liner hangers may be set by expanding the liner hanger radially outward into gripping and sealing contact with the wellbore tubular (e.g., casing, liner, etc.).

Traditional liner hangers often utilize slips for mechanically supporting the liner from the casing and packers to seal the different components. Expandable liner hangers (ELH), such as VERSAFLEX™ ELH available from Halliburton Energy Services, provide improvements over traditional liner hangers. Unlike typical liner hanger systems, ELHs in implementations have no packer element or slips and ELHs can increase reliability of running liners and other deployed solutions to depth. Traditional spikes as sealing elements (and as anchors) may be too soft to bite into thick-walled casing. Moreover, without the strong deformation of the casing, conventional spikes may be too hard to provide a deformable seal over scratched casing. This limits the application of expandable liner hangers for thick-walled casing.

Embodiments herein address sealing and anchoring for expandable liner hangers. Embodiments herein replace the machined engagement spikes on the liner hanger with two rings of different materials. For example, one ring is made from a soft stainless steel (or other soft metal) that provides a seal, and a second ring is from a hard tungsten carbide (or other hard material) that provides an anchor. These two rings may be manufactured by additive manufacturing, such as 3D printing. In implementations, the two rings formed as annular spikes are manufactured by 3D printing on the tool mandrel (base pipe) of the ELH. Beneficially, the 3D printing generally does not damage the heat treatment of the mandrel (tool mandrel of the ELH).

A liner hanger system for use in a subterranean well may include a liner hanger and a well casing. In implementations, the liner hanger may include a spike extending in an annular ring around an outer perimeter of the liner hanger. The spike may have an annular groove defined therein. The liner hanger may further include an annular seal positioned at least partially within the annular groove. The liner hanger can be expandable to transition between an initial state where the spike is not in contact with the well casing and an expanded state where the spike is in contact with the well casing. The spike and the annular seal are configured to seal an uphole well portion from a downhole well portion when the liner hanger is in the expanded state.

First, aspects of the present disclosure for an ELH include stainless on the liner in utilizing a metal that is softer than the liner to make a seal in an ELH. In particular, the hanger liner has a stainless-steel ring that may be a raised portion having a spike or ridges to make a seal with the casing. Second, aspects for an ELH include stainless and carbide on a liner and thus multiple non-elastomeric materials on the liner where the liner is yet another material. These multiple materials have different yield strengths. Third, aspects for a present ELH include carbide peaks with a frangible anchoring feature where that anchoring feature has pre-designed fracture locations that will fracture during the expansion process. The carbide peak may mean that the raised portion (e.g., spike) has carbide peak or tip, but more generally is that the anchor raised portion is constructed from a material that contains tungsten carbide. Carbide is a ceramic (e.g., including tungsten carbide) that has a metal binder. In examples, carbide is a metal alloy that is a cobalt-based or a chromium-based alloy with 2% to 50% tungsten carbide by weight. An engineering specification is how much of the raised portion contains carbide. The entire raised portion could be carbide or only the upper part or peak part of the raised portion could be carbide. In regard to the fractures and the fracturing, as the metal in the liner hanger expands, the ceramic spikes will generally not expand. Ceramics have poor elongation. Rather than have the raised portion break at random locations, fracture can be induced at selected locations. For example, castellations of band can be utilized to create fracture locations.

Fourth, aspects for a present ELH include 3D printing of the anchor and seal on the liner. For example, as a technique of manufacturing that involves 3D printing of the stainless and of the carbide, and in which additional material on the liner is provided so that the heat effected zone (caused by the 3D printing) does not reduce the tensile toughness of the liner. For instance, the outer diameter (OD) of the base pipe can be machined so that the heat affected zone (HAZ) on the base pipe, e.g., from the 3D printing, would be outside of the tensile load path. The 3D printing of the anchor and seal may generally involve melting the metal. Aspects for the ELH include (5) overlapping the carbide with stainless as a technique of enhancing the bonding of the anchor material to the liner by overlaying the anchor material with another material that is less brittle. Such may refer to a peak of carbide where there is stainless steel on the sides of the peak.

In comparison to typical conventional liner hangers, embodiments herein are a liner hanger that can provide a better seal, hold more load, survive more pressure cycles, and seal in heavier wall casing. Moreover, in implementations, sealing may endure even at very low temperature, including with utilizing an austenitic stainless steel for sealing. Further, a relatively inexpensive manufacturing approach of the seals may be employed.

FIG. 1 depicts an ELH that can incorporate seals or sealing elements. An ELH can be characterized as a downhole tool in being a cementing tool in implementations. Cement may be employed (injected) to install (secure) casing in a wellbore and prevent migration of fluids in the annulus between the casing and the wellbore wall.

Once an upper portion of the wellbore has been drilled and cased, it may be desirable to continue drilling and to line a lower portion of the wellbore with a liner lowered through the upper cased portion thereof. Liner hangers are typically used to mechanically support an upper end of the liner from the lower end of a previously installed casing. Additionally, liner hangers may be used to seal the liner to the casing.

ELHs historically have utilized elastomeric rings (e.g., rings made of rubber) as seals or sealing elements carried on a section of expandable tubing to provide both mechanical support and a fluid seal. Once the ELH is placed at a desired position downhole within a casing, an expansion cone may be forced through the ELH. The expansion cone expands the elastomeric rings (if employed) of the ELH, bringing the rings (seals) into contact with the casing to provide both mechanical support and a fluid seal between the casing and a liner.

As indicated in FIG. 1, a borehole as wellbore 10 may be drilled through the Earth surface into a subterranean formation in the Earth crust. A casing 14 may be placed in an upper portion 16 of the wellbore 10 and held in place by cement 18 that is injected between the casing 14 and the upper portion 16 of wellbore 10 wall (formation 12 face in this example). Once the casing 14 is installed, the casing 14 can be considered the wellbore 10 wall of the upper portion 16. With the casing 14 installed, the upper portion 16 may be called a cased borehole or cased wellbore. The inner (inside diameter) surface of the casing 14 may be considered the inner surface (inside diameter) of the wellbore 10 in the upper portion 16.

Below the casing 14, a borehole as a lower portion 20 of the wellbore 10 may be drilled beyond the casing 14. The lower portion 20 may have a smaller diameter than the upper portion 16. A length of liner 22 is shown positioned within the lower portion 20. The liner 22 may line or case the lower portion 20 and/or be utilized to drill the lower portion 20. If desired, cement 18 may be placed adjacent to the liner 22 in the lower portion 20 of the wellbore. The cement 18 may be placed between the liner 22 and the wellbore 10 wall or formation 12 face of the wellbore 10. The liner 22 may be installed in the wellbore 10 via (by means of) a work string 24. The work string 24 may include a releasable collet (not shown) by which the work string 24 can support and rotate the liner 22 as it is placed in the wellbore 10.

Attached to the upper end of, or formed as an integral part of, liner 22 is a liner hanger 26 which may include a number of annular seals 28 (sealing elements). While three seals 28 are depicted for illustrative purposes, any number of seals 28 may be used. A polished bore receptacle 30 (or tie back receptacle) may be coupled to the upper end of the liner hanger 26. The polished bore receptacle 30 may be coupled to the liner hanger 26 by a threaded joint 32, but a different coupling mechanism may be employed. The inner bore of the polished bore receptacle 30 may be smooth and machined to close tolerance to permit work strings, production tubing, etc. to be connected to the liner 22 in a fluid-tight and pressure-tight manner. For instance, a work string may be connected by means of the polished bore receptacle 30 and used to pump fracturing fluid at high pressure down to the lower portion 20 of the wellbore 10 without exposing the casing 14 to the fracturing pressure.

It may be desirable that the outer diameter of liner 22 be as large as possible while being able to lower the liner 22 through the casing 14. It may also desirable that the outer diameter of the polished bore receptacle 30 and the liner hanger 26 be about the same as the diameter of liner 22. In the run-in condition, the outer diameter of liner hanger 26 is defined by the outer diameter of the annular seals 28. In the run-in condition, a body or mandrel 34 of liner hanger 26 has an outer diameter reduced by about the thickness of the seals 28 so that the outer diameter of the seals is about the same as the outer diameter of liner 22 and tie back receptacle 30.

First and second expansion cones 36 and 38 may be carried on the work string 24 just above the reduced diameter body 34 of the liner hanger 26. Fluid pressure applied between the work string 24 and the liner hanger 26 may be used to drive the cones 36, 38 downward through the liner hanger 26 to expand the body 34 to an outer diameter at which the seals 28 are forced into sealing and supporting contact with the casing 14. (Embodiments could expand from the bottom towards the top, in addition to the top-to-bottom technique described.) The first expansion cone 36 may be a solid, or fixed diameter, cone having a fixed outer diameter smaller than the inner diameter 33 of the threaded joint 32. In the run-in condition, second expansion cone 38 may have an outer diameter greater than first cone 36 and also greater than the inner diameter 33 of the threaded joint 32. The second expansion cone 38 may be collapsible, that is, may be reduced in diameter smaller than the inner diameter 33 of the threaded joint 32 when it needs to be withdrawn from the liner hanger 26. In some contexts, the second expansion cone 38 may be referred to as a collapsible expansion cone. After the liner hanger 26 is expanded, expansion cones 36, 38 may be withdrawn from the liner hanger 26, through the polished bore receptacle 30 and out of the wellbore 10 with the work string 24.

Historically, the seals 28 have been made, for example, of elastomeric material, such as rubber. Yet, elastomeric material may be susceptible to degradation due to exposure to downhole temperatures and pressures. Therefore, the seals 28 can include one or more metallic raised portions, such as rings, spikes, ridges, etc.

Figure 2:
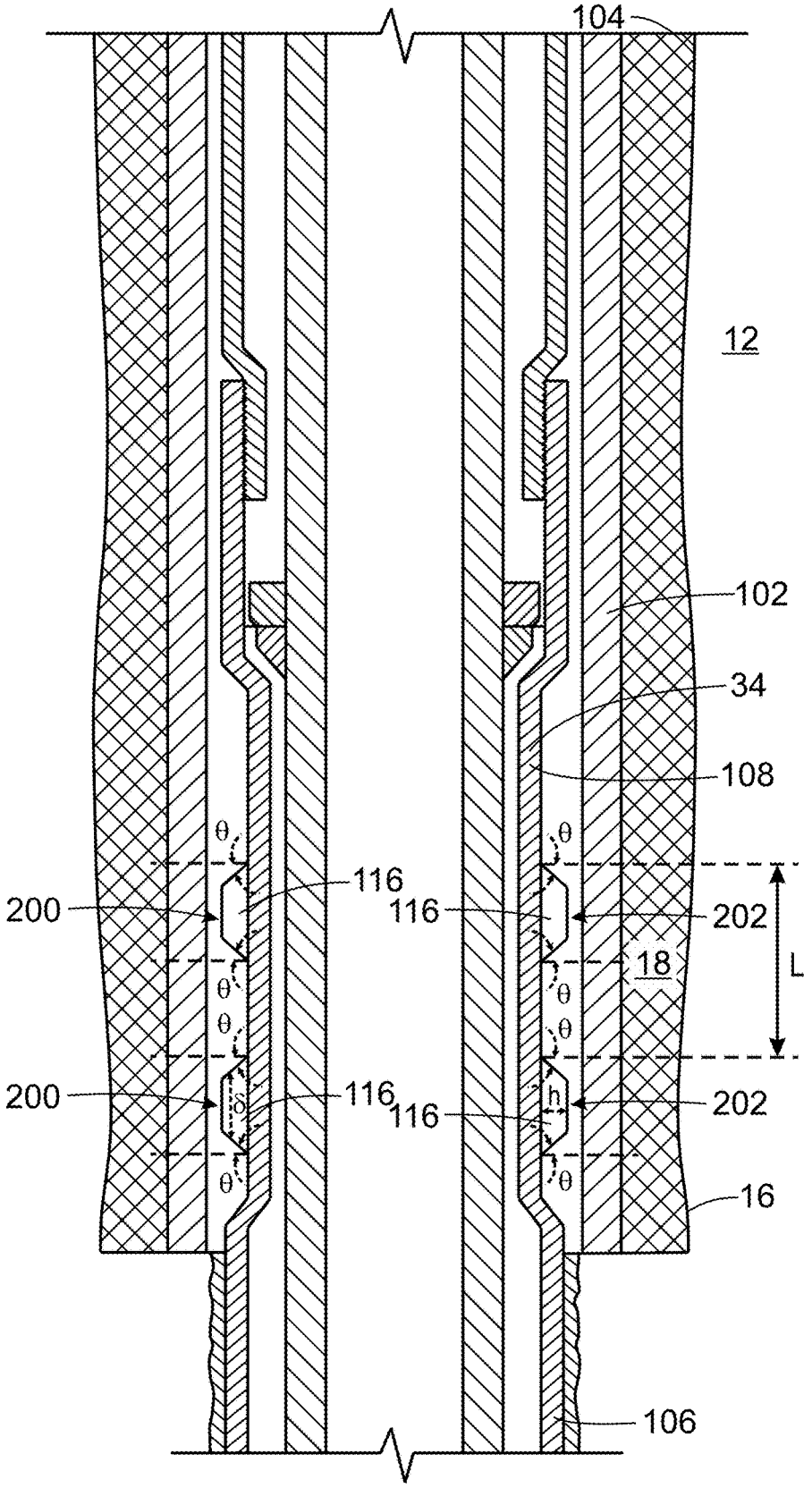
FIG. 2 is a diagram of an ELH.

FIG. 2 is a cross-sectional view of a system, including a liner hanger 26' where spikes 202 (or more generally a raised portion) are (replace) the seals 28. The spikes 202 may be metal spikes. Each spike 202 may be a circular ring. Each spike 202 may extend along an outer perimeter of the liner hanger 26' at a desired axial location, or may extend along an axial direction of the liner hanger 26'. The different spikes 202 can have different surface geometries. A first spike may extend along an outer perimeter of the liner hanger 26' at a first axial position along the liner hanger 26' and a second spike may extend along an outer perimeter of the liner hanger 26' at a second axial position along the liner hanger 26'.

Each of the spikes 202 provides a metal-to-metal seal between the liner hanger 26' and the casing 14. The spikes 202 may have a flat top portion 204. The spikes 202 may be symmetrically aligned such that an angle θ is the same on both sides of each spike 202 as shown in FIG. 2. However, the angle θ may be different on the opposing sides of the spike 202. The angle θ is referred to herein as the "spike angle." The spike angle (θ) may selected such that after expansion, the spikes 202 remain substantially normal to the liner hanger 26' body. For instance, the spike angle (θ) may be selected to be in a range of 30° to 70°.

Moreover, as shown in FIG. 2, the dimension δ denotes the width of the flat portion 204 of the spike 202 and is referred to herein as the spike width (δ). The spike width (δ) may be selected as desired such that the liner hanger 26' can expand without significant increase in expansion pressure while maintaining beneficial contact area between the spikes 202 and the casing 14. Specifically, as the spikes 202 are expanded, the flat portion 204 of the spike interfaces with the inner surface of the casing 14 and will eventually couple the liner hanger 26' to the casing 14. The spikes 202 may be extended using one or more expansion cones in a manner similar to that disclosed in conjunction with expanding the seals 28 of FIG. 1. As shown in FIG. 2, the spacing between the spikes 202 along the length of the liner hanger 26' is denoted as "L". The distance between the spikes (L) may be configured such that the deformation zones in the casing 14 induced by the spikes 202 are isolated. The distance (L) may be selected to maximize the hanging capacity per spike. The term "hanging capacity" refers to the maximum downward load (anchor load) a hanger can carry without inducing an appreciable relative motion between the hanger 26' and the casing 14 after the hanger is set in the casing. Accordingly, it may not be desirable for the distance between the spikes (L) to fall below a certain threshold value. For instance, in certain implementations, it may not be desirable for the distance between the spikes (L) to be less than three times the thickness of the casing 14. Accordingly, the distance (L) between the spikes 202 has an optimum value, which may be dependent upon a number of factors including the outer diameter of the hanger (hanger OD), the hanger wall thickness, the inner diameter of the casing (casing ID) and the casing wall thickness. Moreover, the available length of the liner hanger 26' may limit the number of spikes 202 that may be placed thereon. Beyond this optimum value, an increase in the distance (L) will no longer improve the hanging capacity per spike.

The height (H) of the spikes 202 (and their resulting outer diameter (OD)) may be configured to have dimensions similar to the seals 28. Once the spikes 202 of the liner hanger 26' are expanded, the spikes 202 and the inner diameter of the casing 14 form multiple metal-to-metal seals. The liner hanger 26' is coupled to the liner 22. Accordingly, the spikes 202 of the liner hanger 26' provide mechanical support for the liner 22.

Figure 3B:
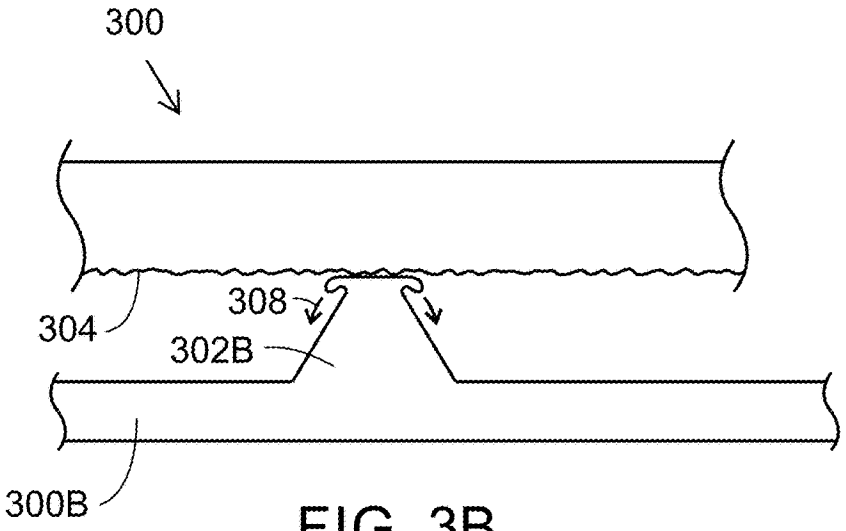
FIG. 3B is a diagram of section of the ELH of FIG. 3B including a second metal spike (as a raised portion) that can form a metal-to-metal anchor with the adjacent metal surface.
Figure 3A:
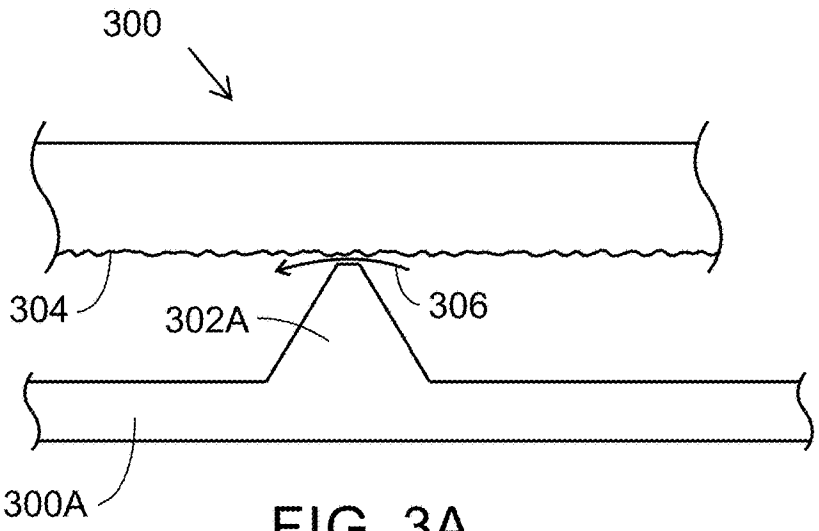
FIG. 3A is a diagram of a section of an ELH including a first metal spike (as a raised portion) that can form a metal-to-metal seal with an adjacent metal surface, such as the inside surface of a metal casing in a wellbore.

FIG. 3A is a section 300 of an ELH including a metal spike 302A (as a raised portion) that can form a metal-to-metal seal with an adjacent metal surface 304. The surface 304 may be the inside surface of a metal casing in a wellbore. The section 300 may be a tool mandrel (or liner) of the ELH. If the metal spike 302A is too hard, the metal spike 302A may not adequately deform to give a satisfactory seal and thus a leak 306 may occur across the seal (between the spike 302A and the surface 304). If the liner hanger material of the spike 302A is too hard and if the spike 302A does not create deformation in the casing, then the liner may leak (as indicated by reference numeral 306) through cracks and surface roughness of the casing.

FIG. 3B is a section 300 of the same ELH of FIG. 3B. The section 300 includes a metal spike 302B (as a raised portion) that can form a metal-to-metal anchor with the adjacent metal surface 304 (e.g., a casing surface). The metal spike 302B may bite into the casing. As mentioned, the section 300 may be the tool mandrel (or liner) of the ELH. The spike 302B prior to application may be a spike form with generally no deformation at the peak. If the metal spike 302B is too soft, the metal spike 302B may excessively deform and thus not anchor to the surface 304. If the spike 302B of the liner hanger is too soft, the spike 302B may deform (as indicated by reference numeral 308) at the peak and not provide sufficient anchoring load.

Referring to FIGS. 3A and 3B, the liner hanger system may include a liner hanger positioned within a casing. The liner hanger may have a spiked portion having one or more spikes, wherein the spikes have a flat portion. At least one of the one or more spikes is expandable and the flat portion of each of the one or more spikes interfaces with the casing when the spike is in the expanded position. A liner is coupled to the liner hanger.

The metal spikes 302A, 302B if spikes machined from the machined from the base pipe 300A, 300B should generally have a careful balance between being too hard versus too soft. However, this balance is difficult when the spikes 302A, 302B are machined from the base pipe 300A, 300B. In contrast, the spikes 302A, 302B as different respective materials (e.g., formed via additive manufacturing) can more readily address beneficial values for hardness.

Figure 4:
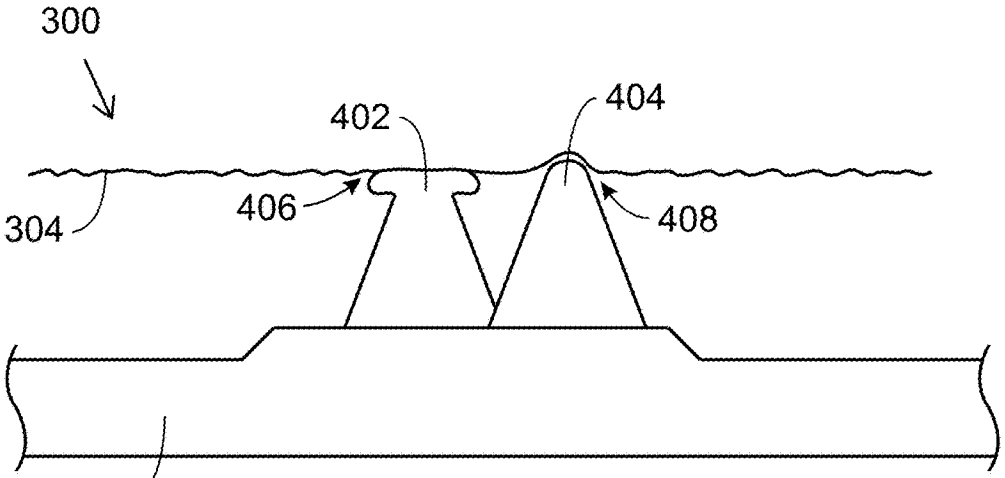
FIG. 4 is a diagram of a section of an ELH including (having) spikes (as raised portions).

FIG. 4 is a section 400 of an ELH including (having) spikes 402, 404 (as raised portions) in accordance with embodiments of the present techniques. The spike 402 is a relatively soft material, such as annealed stainless steel, and is utilized as a sealing element for sealing. The spike 402 may engage 406 a casing surface 304 (in a wellbore) and experience some deformation at the peak as depicted to form a seal (a fluid seal) between the portion 400 (ELH) and the casing. The spike 404 is a relatively hard material, e.g., including carbide (e.g., tungsten carbide) or stellite, and is utilized as an anchor. The spike 404 may engage 408 with (e.g., indent into) the casing surface 304 to anchor the ELH with the casing. The spike 404 may bite or indent into the casing.

Thus, in implementations, two respective non-elastomeric materials are utilized for the spikes 402, 404. One material is a soft metal for the seal spike 402, like stainless steel, that will deform and fill the scratches in the casing. The second material is a hard material for the anchor spike 404, like carbide, that will indent into the casing. The combination is a seal and an anchor. The two spikes (a seal spike 402 and an anchor spike 404) may be run together on an ELH or may be run independent (separately).

As indicated, the spikes 402, 404 (as well as spikes or other raised portions in remaining figures) may be on an ELH base pipe 410, such as an ELH mandrel or ELH liner. The base pipe 410 may be a liner and/or tool mandrel of the ELH. The liner and tool mandrel can be congruent. For instance, in implementations, the mandrel can be part of the liner or attached to the liner, e.g., to seal the liner or anchor the liner. The tool mandrel can be a liner. Again, in implementations, the mandrel can be considered part of the liner.

In implementations, the spikes 402, 404 (or raised portions generally) may be fabricated by additive manufacturing, such as 3D printing or other additive manufacturing techniques. The additive manufacturing may be broadly considered including any technique that is not subtractive manufacturing. In implementations, a spike or other raised portion may be the same material as a base pipe 410 that is the ELH liner (or the liner coupled to the ELH) to which the spike is attached and can be created by machining away material of the liner (or portion of the liner) until what remains is the spike on the remaining liner. Thus, spikes or raised portions generally as a seal or anchor can be created (formed) through subtractive manufacturing and other spikes or raised portions created (formed) with additive manufacturing that uses a different material than the liner hanger.

Note in this illustrated implementation, the spikes 402, 404 are welded to a raised region 412 of the liner (base pipe). The heat effected zone from the welding process can be contained within that raised region 412. The raised region 412 may be utilized (relied on) to prevent the welding heat from reducing the axial strength of the liner.

Tungsten carbide is approximately twice as stiff as steel, with a Young's modulus of approximately 530-700 gigapascals (GPa), and is about double the density of steel. Tungsten carbide is comparable with corundum ($\alpha$-Al2O3) in hardness. The hardness can be, for example, about 2500-2600 Vickers hardness (HV). While tougher than ceramics generally, tungsten carbide may be considered a metal/ceramic hybrid, combining the properties of metals and ceramics.

Stellite is generally a range of cobalt-chromium alloys that may also include tungsten or molybdenum and a small amount of carbon. The carbon may provide a significant contribution to the material properties. Stellite alloys are a range of cobalt-based alloys, with significant proportions of chromium (up to 33%) and tungsten (up to 18%). Some of the alloys also contain nickel or molybdenum. Most of them are fairly high carbon content when compared to carbon steels, though they contain less than 3% iron, and in the stellite alloys the carbon may primarily be associated with the chromium to form hard chromium carbide particles which are dispersed in the cobalt-based matrix. Stellite may be a trademark of certain alloys containing cobalt, chromium, carbon, tungsten, and molybdenum. For instance, STELLITE® alloy 6B is of Haynes International, Inc. having headquarters in Kokomo, Indiana.

Figure 5:
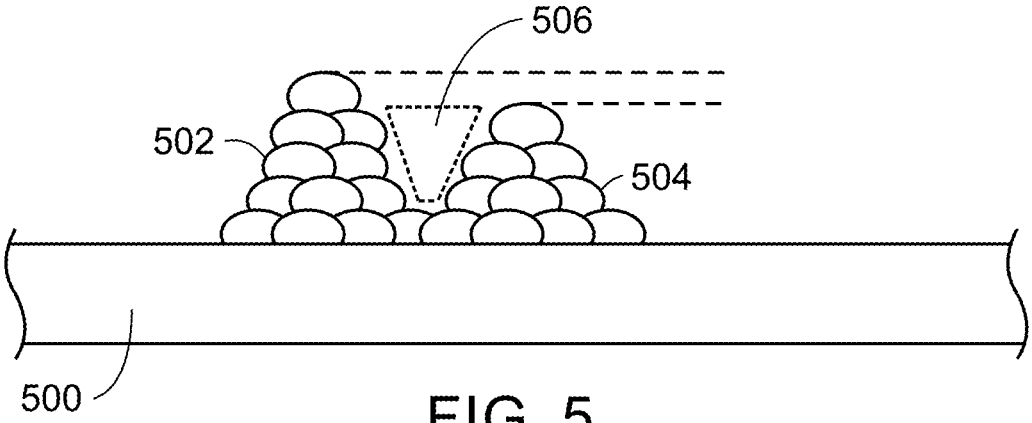
FIGS. 5, 6, and 7 are each a diagram of a section of a respective ELH having a first raised portion (soft material) and a second raised portion (hard material).

FIG. 5 is a section 500 of an ELH including the raised portion 502 (soft material) for a seal and the raised portion 504 (hard material) for an anchor. The raised portions 502, 504 may be situated on a base pipe 506 (e.g., tool mandrel) of the ELH. The soft metal raised portion 502 is taller than the hard raised portion 504 and has space to deform, as indicated at least by the two dashed horizontal lines and the void volume 508. There is volume around or adjacent to the soft metal that is sufficient for the expected deformation of the soft metal. For instance, the void volume 508 (squish space) facilitates that the soft metal generally does not entomb the hard metal and thus does not interfere with or prevent the anchoring by the hard raised portion 504.

As shown in FIG. 5, the raised portion 502 (soft metal) may have a higher profile than the raised portion 504 (hard material). This higher profile helps to ease run-in because the hard material would generally not be knocked-off with a bump on the casing. The higher profile also facilitates that the soft metal is deformed into the surface of the casing to form a good seal. The bubbles depiction of the raised portion 502 (metal) and the raised portion 504 (metal or metal ceramic) is a representation to indicate the multiple passes from the additive manufacturing process (3D printing) of forming the raised portions 502, 504.

Figure 6:
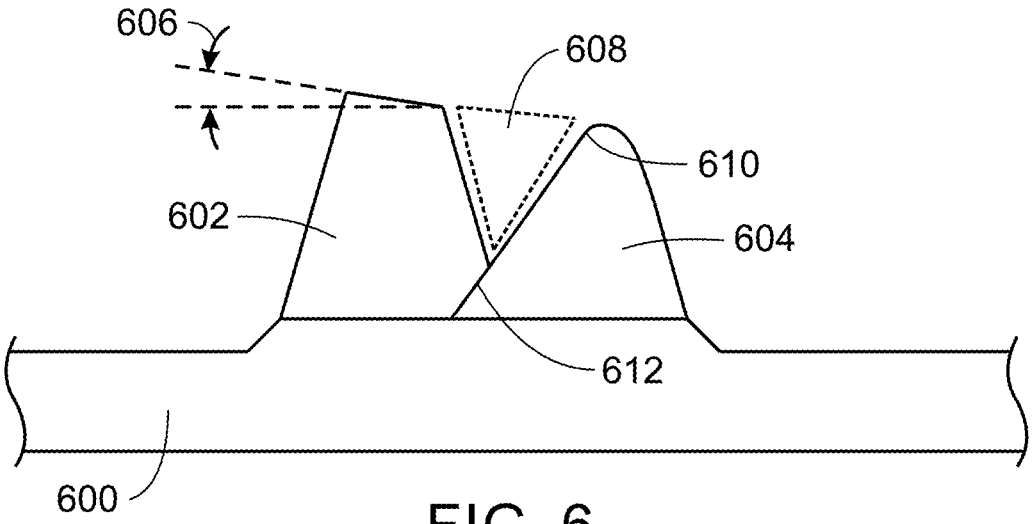

FIG. 6 is a section 600 of an ELH having a spike 602 (soft material) and a spike 604 (hard material) situated on a base pipe 605 (e.g., tool mandrel or liner) of the ELH. The spikes 602, 604 may each be characterized as a raised portion. Asymmetry in the profile of each spike 602, 604 is depicted. Also, the softer material can overlay the harder material (as indicated by reference numeral 606) and provide additional support to shear loads. The spike 602 does not have to have a symmetric profile. The spike 604 does not have to have a symmetric profile. The spikes 602, 604 do not have to be symmetric with respect to each other. In implementations, the liner hanger (having the section 600) is expanded by running a cone under the liner as a base pipe 605. Consequently, the shear loads on the spikes 602, 604 will typically be directional.

The profile of each spike 602, 604 can be varied between the top and the bottom side. In one example, the spike is asymmetric so that shear loads during setting are reduced. In the illustrated example, the profile of the spike 604 is asymmetric 608 in that the profile of the downhole side (to the right) is steeper than the profile on the uphole side (to the left). Further, in this example, the top of the spike 602 is not parallel to the longitudinal axis of the liner (as base pipe 605) and is at an angle 610. There is a void volume 612 (squish space) between the spikes 602, 604.

Figure 7:
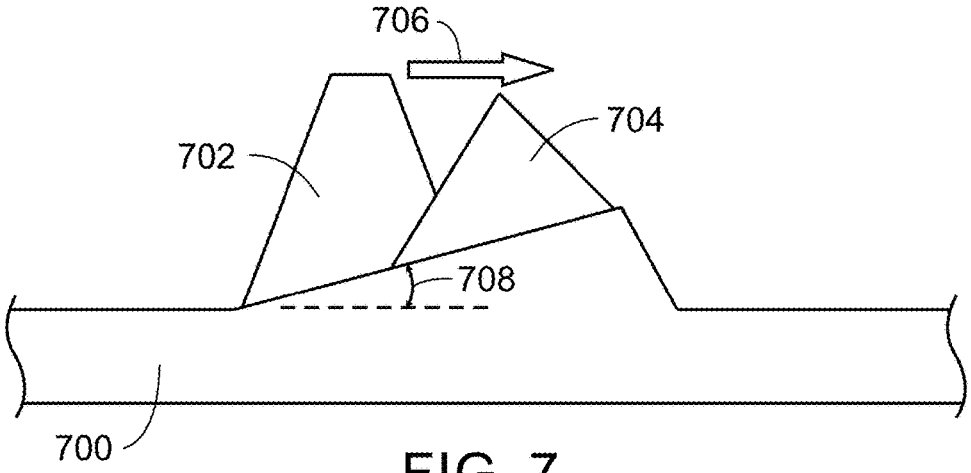

FIG. 7 is a section 700 of an ELH including the spike 702 (soft metal) and the spike 704 (hard material). An angled contact surface with the base pipe 706 is depicted. The softer material will have greater strain to failure than the harder material and will also often have greater toughness. These properties can be utilized to aid the bonding of the hard material by having the soft material overlay the hard material, as also shown in FIG. 6. The shear loads on the spikes can be reduced by angling 708 the attachment surface, as shown in FIG. 7. The arrow 710 is generally representative of contact force during expansion of the ELH in application. In implementations, more of the contact forces will be in the normal direction rather than in a shear direction.

Figure 8:
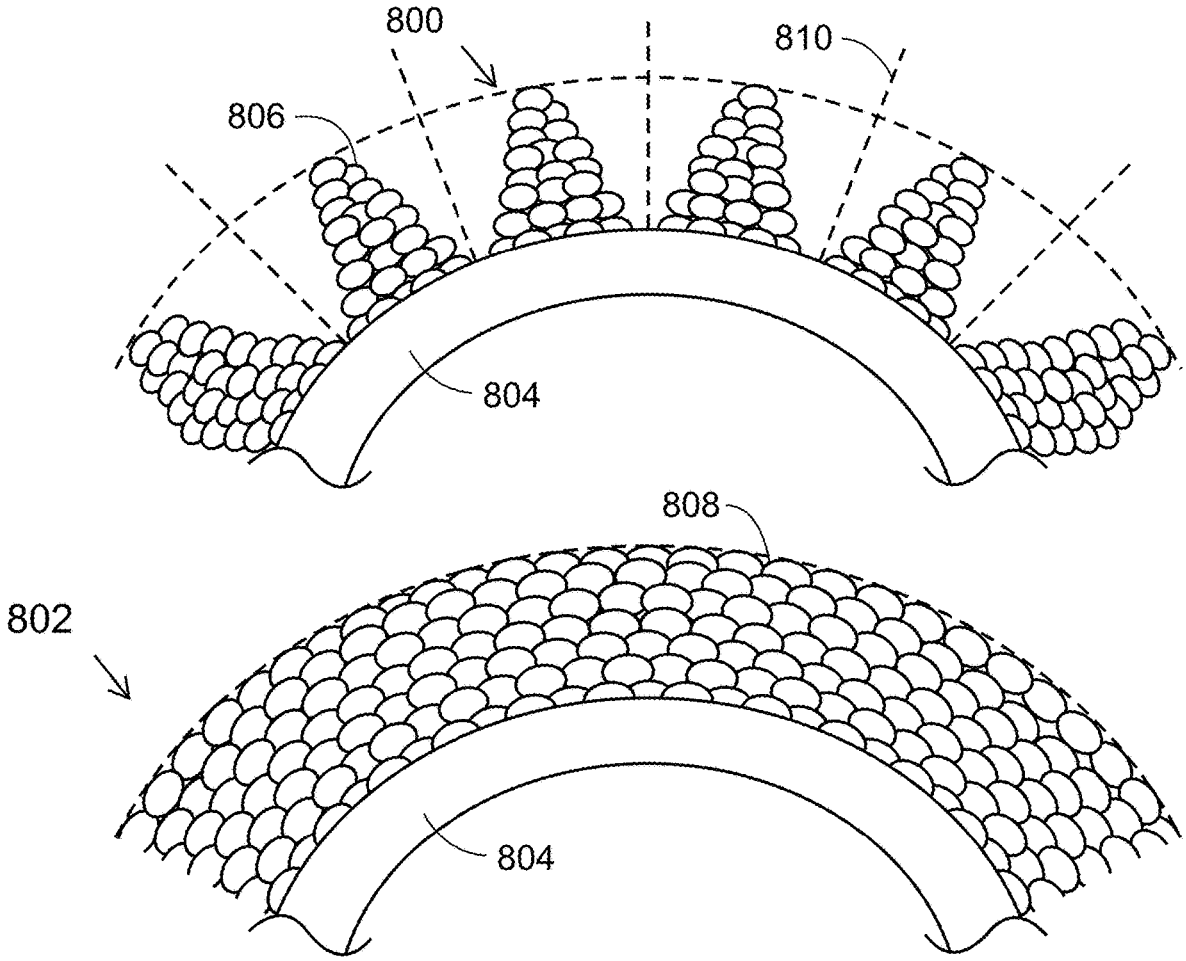
FIG. 8 is a diagram of an axial view of a sealing layer and an anchoring layer situated on a base pipe of an ELH.

FIG. 8 is an axial view of an anchoring layer 800 and a sealing layer 802 situated on a base pipe 804 of an ELH. In the illustrated embodiment, the anchoring layer 800 has raised portions 806 of hard material, as discussed. The sealing layer 802 has a raised portion 808 of soft metal, as discussed. During expansion, the anchoring layer 800 may fracture and this fracturing may occur along pre-designed fracture lines 810. The hard material may have a lower strain to failure than the liner hanger and may fracture during the expansion of the liner hanger. In a conventional liner hanger, this fracturing limits the hardness of the spike because fractures in a single spike would create pathways for leaks. In embodiments herein, fractures in the anchor may not be relevant because of utilizing the malleable metal for the seal. Thus, the soft metal should generally be a continuous ridge in implementations, as shown for the sealing layer 802 in FIG. 8. The hard material can have pre-designed fracture lines 810 so that the hard material will fracture in an expected pattern. The raised portions 806 of hard material of the anchoring layer 800 may generally have a height that varies in the circumferential direction, as shown in FIG. 8.

The soft metal (of the sealing layer raised portion 808) can beneficially be a metal with high malleability and a low yield strength. The malleability allows greater deformation before the sealing layer fractures. Lower yield stress requires less force to achieve this deformation. Examples of soft metal include stainless steel (SS) like SS301, SS304, SS317, and SS316. SS301 has 60% elongation, which can be beneficial. Other soft metals include copper, tin, nickel, aluminum, bismuth, silver, iron, vanadium, and alloys of these materials. As another example, the soft metal could be brass or copper. The soft metal may be heat treated, such as through annealing, to make the soft metal softer.

The hard material (of the anchoring layer raised portions 806) may beneficially be a material with high hardness and high yield strength. The hardness and yield strength facilitate that this hard material can deform the casing rather than having the casing deform the hard material. Examples of hard materials include cobalt-based alloys such as the cobalt-chromium alloys used in Stellite, nickel-based alloys, chromium carbide alloys, and iron-based alloys. These alloys may be dispersed with ceramic components, such as carbide (like tungsten carbide), to further increase the hardness.

Figure 9:
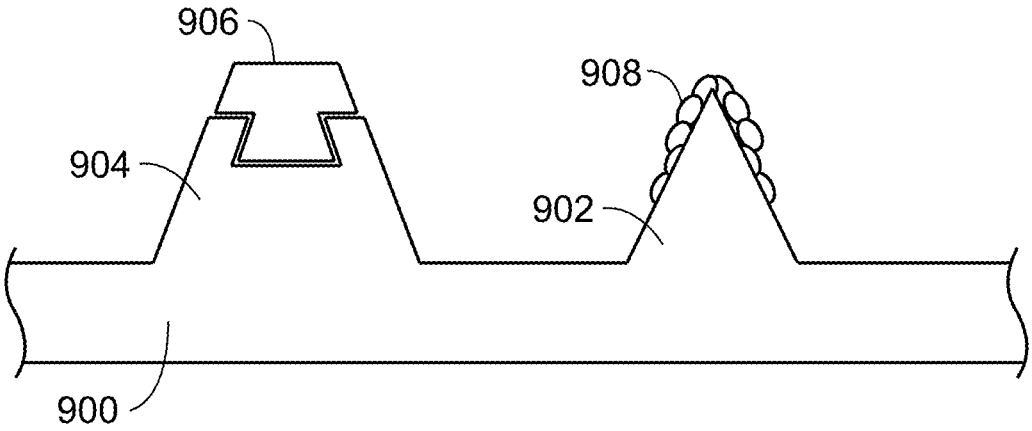
FIG. 9 is a diagram of a section of an ELH having an anchor spike and a seal spike on a base pipe of the ELH.

FIG. 9 is a section 900 of an ELH having an anchor spike 902 and a seal spike 904 situated on a base pipe 906 of the ELH. The spikes 902, 904 are each a form of a raised portion. Depicted is an implementation in which at least the upper part of the spikes 902, 904 that interfaces with casing is formed by additive manufacturing but not 3D printed. There are additive manufacturing options in addition to 3D printing. In the depicted example, soft metal 908 (as discussed) of the seal spike 902 can be an insert as the sealing element (seal). Hard material 910 (e.g., including hard metal and optionally carbide, as discussed) of the anchor spike 904 can be a layer (thicker than coating) utilized in anchoring to the casing. Thus, FIG. 9 depicts an embodiment in which at least a portion of the seal spike 902 and at least a portion of the anchor spike 904 are created (formed) in a process of additive manufacturing that is not 3D printing.

Additive manufacturing is distinctly different from subtractive manufacturing where a cutting tool is used to remove material in subtractive manufacturing while new material is added to the part in additive manufacturing. There are additional manufacturing options for additive manufacturing including laser melting, casting, and pressing. For instance, the soft metal 908 can be added to the spike 902 in a process of additive manufacturing involving pressing an insert into a groove on the spike 902. The groove may be constructed from subtractive manufacturing whereas the soft metal 908 is added in an additive manufacturing step. The hard material 910 as an outer layer (distinguishable from a coating) of the spike 904 can be formed, for instance, in a process of additive manufacturing involving laser melting of a powder.

The soft material 908 insert and the hard material 910 layer are generally not a coating. A hard coating will typically fracture and generally not bite into the casing. The hard material 910 layer should have a greater thickness than a coating to give the stiffness for creating the bit. The soft material 908 and the hard material 910 are each at least 500 microns thick (e.g., in the ranges of 500 microns to 10 mm, or 1 mm to 10 mm) and thus thicker than a coating.

Figure 10:
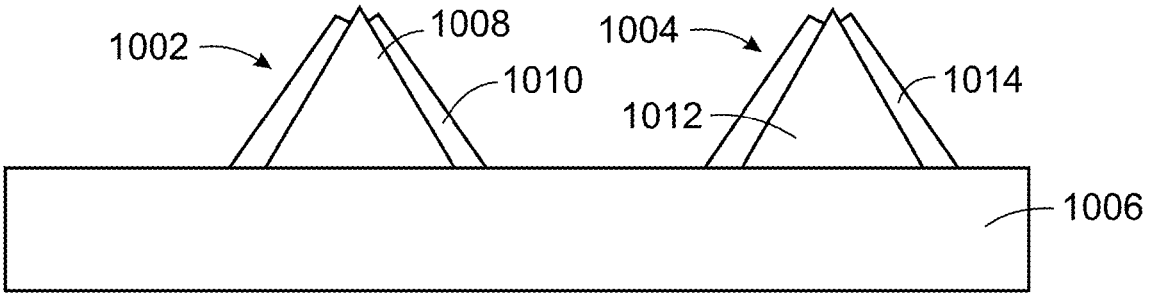
FIG. 10 is a section of an ELH having a first rib and a second rib on a base pipe of the ELH.

FIG. 10 is a section 1000 of an ELH having a first rib 1002 and a second rib 1004 situated on a base pipe 1006 of the ELH. The base pipe 1006 may be a liner and/or tool mandrel of the ELH. The first rib 1002 and the second rib 1004 are each a layered structure. The ribs 1002, 1004 can be utilized to seal with an adjacent surface (e.g., inside surface of a wellbore casing), thus forming a fluid seal between the ELH and the adjacent surface. The ribs 1002, 1004 can be utilized to anchor the ELH to the adjacent surface.

The first rib 1002 includes a hard core 1008 for anchoring and a soft shell 1010 for sealing. The second rib 1004 includes a soft core 1012 for sealing and a hard shell 1014 for anchoring. The hard core 1008 and the hard shell 1014 may each be hard material, as discussed. The soft shell 1010 and the soft core 1012 may each be soft metal, as discussed. The soft shell 1010 and the hard shell 1014 are not coating but instead each a layer having a thickness of at least 500 microns or at least 1 mm. In implementations, the soft shell 1010 (of the first rib) and the soft core 1012 (of the second rib) can be characterized collectively as a raised portion that is soft metal, and the hard core 1008 (of the first rib) and the hard shell 1014 (of the second rib) can be characterized collectively as another raised portion that is hard material.

Figure 11:
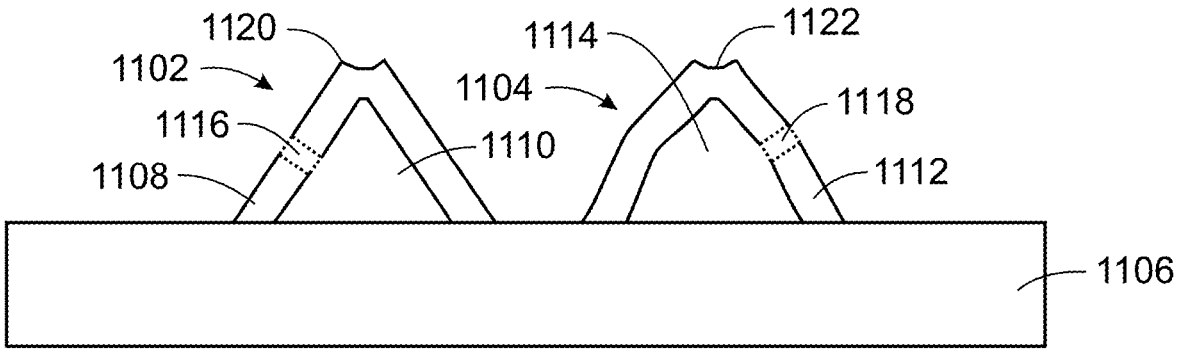
FIG. 11 is a section of an ELH having a first sealing rib and a second sealing rib on a base pipe 1106 of the ELH.

FIG. 11 is a section 1100 of an ELH having a sealing rib 1102 and a sealing rib 1104 situated on a base pipe 1106 of the ELH. The base pipe 1106 may be a liner and/or tool mandrel of the ELH. In implementations, sealing rib 1102 and the sealing rib 104 can be characterized collectively as a raised portion that includes soft metal, and that is a raised portion as a seal or for sealing.

The ribs 1102, 1104 as a sealing layer of the ELH may include flexural bending in forming a fluid seal with the wellbore casing (with the inside surface of the casing). In implementations, the left sealing rib 1102 may hold pressure from the left, and the right sealing rib 1104 may hold pressure from the right.

The first sealing rib 1102 has a strut 1108 (e.g., flexible strut) and a cavity 1110 (e.g., hollow cavity) to the inside of the strut 1108 as depicted. Likewise, the second sealing rib 1104 has a strut 1112 (e.g., flexible strut) and a cavity 1114 (e.g., hollow cavity) to the inside of the strut 1112 as depicted. The struts 1108, 1112 may flex during the setting of the ELH in the wellbore, e.g., at least in the sealing of the ELH with the wellbore casing. The bending may facilitate maintaining contact with the casing during movement of the casing and the liner, such as during elastic recoil after setting or during periods of applied pressure.

In some cases, the sealing ribs have pressure passages through the struts for the cavities that allow pressure to be applied (e.g., from one direction) for each rib. In the illustrated embodiment, the sealing rib 1102 has a pressure passage 1116 through the strut 1108 to the cavity 1110. Likewise, the sealing rib 1104 has a pressure passage 1118 through the strut 1112 to the cavity 1114. Applied pressure may cause the sealing ribs to enhance their contact pressure in much the way that a self-energizing seal increases the contact pressure during the application of a differential pressure. Note that different ribs may be used to achieve a pressure seal in different directions. The right sealing rib 1104 and the left sealing rib 1102 may have different shapes (as shown) or they may be the same shape. In the depicted example, the strut 1108 has a contoured contact surface 1120 and the strut 1112 has a contoured contact surface 1122. The contact surfaces 1120, 1122 being contour may facilitate or promote forming of the fluid seal via the sealing ribs 1102, 1104 with the inside surface of the wellbore casing.

An embodiment is an ELH having a first raised portion as a sealing element that has a first material (e.g., a first metal) to engage a casing in a wellbore to form a seal between the ELH and the casing. The ELH has a second metal raised portion as an anchor that has a second material to engage the casing to anchor the ELH with the casing, wherein the first material is softer than the second material, such as based on BHN (HBW) or HV. In implementations, the first raised portion and the second raised portion are each disposed about a tool mandrel or liner of the expandable liner hanger. The first raised portion (e.g., first spike) and the second raised portion (e.g., second spike) may each be a ring. The first raised portion and the second raised portion may each be fabricated by additive manufacturing (e.g., 3D printing, etc.). In implementations, the first raised portion includes stainless steel, such as stainless steel 301, stainless steel 304, stainless steel 316, or stainless steel 317, and the like. In implementations, the first raised portion includes copper, tin, nickel, aluminum, bismuth, silver, iron, or vanadium, or any combinations thereof. In implementations, the first raised portion includes an alloy of at least two of copper, tin, nickel, aluminum, bismuth, silver, iron, or vanadium. In implementations, the first raised portion includes brass or copper. In implementations, the raised portion is an annealed metal (e.g., annealed stainless steel, etc.). In implementations, the second raised portion includes a ceramic. In implementations, the second raised portion includes a cobalt-based alloy, a cobalt-chromium alloy, a nickel-based alloy, a chromium carbide alloy, an iron-based alloy, or tungsten carbide, or any combinations thereof.

Another embodiment is a method of applying an ELH, including moving the ELH to a selected position (e.g., specified depth) in a wellbore, wherein a first raised portion and a second raised portion are disposed about the ELH. The first raised portion (e.g., a first spike) and the second raised portion (e.g., a second spike) being disposed about the ELH may involve the first raised portion and the second raised portion each disposed about a based pipe (e.g., a tool mandrel or liner) of the ELH. The second raised portion is harder than the first raised portion. The method includes engaging wellbore casing in the wellbore with the first raised portion to form a seal between the ELH and the wellbore casing. The method includes engaging wellbore casing in the wellbore with the second raised portion to anchor the ELH to the wellbore casing. As discussed, the first raised portion and the second raised portion may each be fabricated by additive manufacturing (e.g., 3D printing). As generally discussed, the first raised portion may include, for example stainless steel, copper, tin, nickel, aluminum, bismuth, silver, iron, or vanadium, or any combinations thereof. The first raised portion can be an annealed metal. The second raised portion can be, for example, a cobalt-based alloy, a cobalt-chromium alloy, a nickel-based alloy, a chromium carbide alloy, an iron-based alloy, or tungsten carbide, a ceramic, or any combinations thereof.

In view of the foregoing, the present disclosure may provide for an ELH having a first metal spike to form a seal and/or a second metal spike as an anchor, wherein the second metal spike is harder than the first metal spike. The apparatus and methods may include any of the various features disclosed herein, including one or more of the following statements.

Statement 1. An expandable liner hanger comprising: a first raised portion as a sealing element to engage a casing in a wellbore to form a seal between the expandable liner hanger and the casing, wherein the first raised portion comprises a first metal; and a second raised portion as an anchor to engage the casing to anchor the expandable liner hanger with the casing, wherein the second raised portion comprises a second metal harder than the first metal.

Statement 2. The expandable liner hanger of Statement 1, wherein the first raised portion and the second raised portion are on a base pipe of the expandable liner hanger, wherein the first metal is softer than the base pipe, and wherein the second metal is harder than the base pipe.

Statement 3. The expandable liner hanger of statement 1 or statement 2, wherein the first raised portion and the second raised portion are each disposed about a tool mandrel or liner of the expandable liner hanger.

Statement 4. The expandable liner hanger of any preceding statement, wherein the first raised portion and the raised portion are each a spike form.

Statement 5. The expandable liner hanger of any preceding statement, wherein the first raised portion and the raised portion each comprise a ring.

Statement 6. The expandable liner hanger of any preceding statement, wherein the first raised portion and the second raised portion are each fabricated by additive manufacturing.

Statement 7. The expandable liner hanger of any preceding statement, wherein the first metal comprises annealed metal.

Statement 8. The expandable liner hanger of any preceding statement, wherein the first metal comprises annealed stainless steel.

Statement 9. The expandable liner hanger of any preceding statement, wherein the first metal comprises stainless steel 301, stainless steel 304, stainless steel 316, or stainless steel 317.

Statement 10. The expandable liner hanger of any preceding statement, wherein the first metal comprises copper, tin, nickel, aluminum, bismuth, silver, iron, or vanadium, or any combinations thereof.

Statement 11. The expandable liner hanger of any preceding statement, wherein the first metal comprises an alloy of at least two of copper, tin, nickel, aluminum, bismuth, silver, iron, or vanadium.

Statement 12. The expandable liner hanger of any preceding statement, wherein the first metal comprises brass or copper.

Statement 13. The expandable liner hanger of any preceding statement, wherein the second raised portion comprises a ceramic.

Statement 14. The expandable liner hanger of any preceding statement, wherein the first raised portion comprises a first rib having a first cavity and a second rib having a second cavity.

Statement 15. The expandable liner hanger of any preceding statement, wherein the second metal comprises a cobalt-based alloy, a cobalt-chromium alloy, a nickel-based alloy, a chromium carbide alloy, an iron-based alloy, or tungsten carbide, or any combinations thereof.

Statement 16. A method of applying an expandable liner hanger, comprising: moving the expandable liner hanger to a selected position in a wellbore, wherein a first raised portion comprising a first metal and a second raised portion comprising a second metal are disposed about a base pipe of the expandable liner hanger; engaging wellbore casing in the wellbore with the first raised portion to form a seal between the expandable liner hanger and the wellbore casing; and engaging the wellbore casing with the second raised portion, thereby anchoring the expandable liner hanger to the wellbore casing, wherein the first metal is softer than the second metal.

Statement 17. The method of statement 16, wherein the first raised portion and the second raised portion are each fabricated by additive manufacturing comprising three-dimensional (3D) printing.

Statement 18. The method of statement 16 or statement 17, wherein the base pipe comprises a tool mandrel of the expandable liner hanger or a liner of the expandable liner hanger.

Statement 19. The method of statements 16-18, wherein the first metal comprises an annealed metal.

Statement 20. The method of statements 16-19, wherein the first metal comprises stainless steel, copper, tin, nickel, aluminum, bismuth, silver, iron, or vanadium, or any combinations thereof.

Statement 21. The method of statements 16-20, wherein the second metal comprises a cobalt-based alloy, a cobalt-chromium alloy, a nickel-based alloy, a chromium carbide alloy, an iron-based alloy, tungsten carbide, a ceramic, or any combinations thereof.

The present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An expandable liner hanger comprising:

a first raised portion as a sealing element to engage a casing in a wellbore to form a seal between the expandable liner hanger and the casing, wherein the first raised portion comprises a first metal; and a second raised portion as an anchor to engage the casing to anchor the expandable liner hanger with the casing, wherein the second raised portion comprises a second metal harder than the first metal, wherein the first raised portion and the second raised portion are on a base pipe of the expandable liner hanger, wherein the first metal is softer than the base pipe, and wherein the second metal is harder than the base pipe.

2. The expandable liner hanger of claim 1, wherein the first raised portion and the second raised portion are each disposed about a tool mandrel or liner of the expandable liner hanger.

3. The expandable liner hanger of claim 1, wherein the first raised portion and the raised portion are each a spike form.

4. The expandable liner hanger of claim 1, wherein the first raised portion and the raised portion each comprise a ring.

5. The expandable liner hanger of claim 1, wherein the first raised portion and the second raised portion are each fabricated by additive manufacturing.

6. The expandable liner hanger of claim 1, wherein the first metal comprises annealed metal.

7. The expandable liner hanger of claim 1, wherein the first metal comprises annealed stainless steel.

8. The expandable liner hanger of claim 1, wherein the first metal comprises stainless steel 301, stainless steel 304, stainless steel 316, or stainless steel 317.

9. The expandable liner hanger of claim 1, wherein the first metal comprises copper, tin, nickel, aluminum, bismuth, silver, iron, or vanadium, or any combinations thereof.

10. The expandable liner hanger of claim 1, wherein the first metal comprises an alloy of at least two of copper, tin, nickel, aluminum, bismuth, silver, iron, or vanadium.

11. The expandable liner hanger of claim 1, wherein the first metal comprises brass or copper.

12. The expandable liner hanger of claim 1, wherein the second raised portion comprises a ceramic.

13. The expandable liner hanger of claim 1, wherein the first raised portion comprises a first rib having a first cavity and a second rib having a second cavity.

14. The expandable liner hanger of claim 1, wherein the second metal comprises a cobalt-based alloy, a cobalt-chromium alloy, a nickel-based alloy, a chromium carbide alloy, an iron-based alloy, or tungsten carbide, or any combinations thereof.

15. A method of applying an expandable liner hanger, comprising:

moving the expandable liner hanger to a selected position in a wellbore, wherein a first raised portion comprising a first metal and a second raised portion comprising a second metal are disposed about a base pipe of the expandable liner hanger;

engaging wellbore casing in the wellbore with the first raised portion to form a seal between the expandable liner hanger and the wellbore casing; and engaging the wellbore casing with the second raised portion, thereby anchoring the expandable liner hanger to the wellbore casing, wherein the first metal is softer than the second metal, wherein the first raised portion and the second raised portion are on a base pipe of the expandable liner hanger, wherein the first metal is softer than the base pipe, and wherein the second metal is harder than the base pipe.

16. The method of claim 15, wherein the first raised portion and the second raised portion are each fabricated by additive manufacturing comprising three-dimensional (3D) printing.

17. The method of claim 15, wherein the base pipe comprises a tool mandrel of the expandable liner hanger or a liner of the expandable liner hanger.

18. The method of claim 15, wherein the first metal comprises an annealed metal.

19. The method of claim 15, wherein the first metal comprises stainless steel, copper, tin, nickel, aluminum, bismuth, silver, iron, or vanadium, or any combinations thereof.

20. The method of claim 15, wherein the second metal comprises a cobalt-based alloy, a cobalt-chromium alloy, a nickel-based alloy, a chromium carbide alloy, an iron-based alloy, tungsten carbide, a ceramic, or any combinations thereof.

* * * * *